US008189742B2

(12) United States Patent
Behling

(10) Patent No.: US 8,189,742 B2
(45) Date of Patent: May 29, 2012

(54) FAST DOSE MODULATION USING Z-DEFLECTION IN A ROTARING ANODE OR ROTARING FRAME TUBE

(75) Inventor: Rolf Karl Otto Behling, Norderstedt (DE)

(73) Assignee: Koninklijke Philips Electronics NV, Eindhoven (NL)

( * ) Notice: Subject to any disclaimer, the term of this patent is extended or adjusted under 35 U.S.C. 154(b) by 42 days.

(21) Appl. No.: 12/664,451

(22) PCT Filed: Jun. 17, 2008

(86) PCT No.: PCT/IB2008/052377

§ 371 (c)(1), (2), (4) Date: Dec. 14, 2009

(87) PCT Pub. No.: WO2008/155715

PCT Pub. Date: Dec. 24, 2008

(65) Prior Publication Data

US 2010/0172475 A1 Jul. 8, 2010

(30) Foreign Application Priority Data

Jun. 21, 2007 (EP) ..... 07110781

(51) Int. Cl.
*H01J 35/30* (2006.01)

(52) U.S. Cl. ..... 378/137; 378/124; 378/144

(58) Field of Classification Search ..... 378/137, 378/124, 125, 144

See application file for complete search history.

(56) References Cited

U.S. PATENT DOCUMENTS

| | | | | |
|---|---|---|---|---|
| 3,250,916 | A * | 5/1966 | Rogers | 378/144 |
| 4,464,778 | A * | 8/1984 | Goldmann | 378/150 |
| 4,610,021 | A | 9/1986 | Peschmann et al. | |
| 5,574,763 | A * | 11/1996 | Dehner | 378/17 |
| 6,487,274 | B2 | 11/2002 | Bertsche | |
| 6,826,255 | B2 | 11/2004 | Birdwell et al. | |
| 2004/0190675 | A1 * | 9/2004 | Birdwell et al. | 378/137 |
| 2005/0163281 | A1 | 7/2005 | Negle | |

FOREIGN PATENT DOCUMENTS

| | | | |
|---|---|---|---|
| GB | 1602011 | | 11/1981 |
| JP | 54023492 | A | 2/1979 |
| WO | 2007074029 | A1 | 7/2007 |

* cited by examiner

*Primary Examiner* — Glen Kao

(57) ABSTRACT

A fast dose modulation using a z-deflection in a rotating anode or a rotating frame tube, where the electron beam is deflected from a first focal spot region to a second focal spot region being formed on the anode, wherein only the electromagnetic beam generated in the first focal spot region contributes to the useful electromagnetic exposure beam, wherein the second focal spot region is designed to avoid emission of electromagnetic beams into the direction of a useful electromagnetic beam direction.

14 Claims, 4 Drawing Sheets

FAST DOSE MODULATION USING Z-DEFLECTION IN A ROTARING ANODE OR ROTARING FRAME TUBE

FIELD OF THE INVENTION

The present invention relates to an exposure tube component, an anode for an exposure tube component and an examination exposure apparatus, and in particular to an exposure tube component for electromagnetic ray, in particular X-ray generation being capable of a fast dose modulation.

BACKGROUND OF THE INVENTION

A fast dose modulation in exposure tubes, in particular X-ray exposure tubes, is desirable to minimise a patient dose in a computer tomography (CT). The desired speed of modulation increases with an increased gantry speed in order to enable a faster control of the photon flux. While maintaining a high photon flux in those phases of a computer tomography scan, in which phases diagnostic information has to be gained with a high definition or where the penetration through the object is poor, it is desirable to cut back on photon flux in other phases.

US 2005/0163281 A1 describes an X-ray tube which includes a device for at least substantially protecting an object to be examined against the incidence of undesirable X-rays, which can be produced noticeably by the decay of a residual or surplus charge present in a high voltage circuit after an X-ray exposure. US 2005/0163281 A1 describes a device for deflecting and/or defocusing the electron beam produced by the residual and/or surplus charge in such a manner that at least it is not incident to a significant extent on a region of an anode where from X-rays excited thereby are directed towards an object to be examined, namely to an exterior radiation collector.

In some applications, the flux should not cease to zero, but remain at a certain level for a while, and the maximum focal spot size should be maintained, at least not exceeded. If the transient is fast compared to the period of one computer tomography view, typically some hundred microseconds, pulse with modulation may become possible to control the overall photon flux very quickly. In present applications, the photon flux is either controlled by switching the high voltage on and off with a transition time of about half a millisecond, or by driving the filament temperature of the tube up and down within some hundred milliseconds. Thus, either the modulation is not maintaining a certain minimum level, and/or it is too slow or the focal spot is unacceptably distorted.

SUMMARY OF THE INVENTION

It would be desirable to provide an exposure tube component, an anode or an examining exposure apparatus, which is capable of a more precise and fast dose modulation.

The invention provides an exposure tube component, an anode and an examining exposure apparatus for an electromagnetic ray generation according to the subject matter of the independent claims. Further embodiments are incorporated in the dependent claims.

According to an exemplary embodiment of the invention, an exposure tube component for electromagnetic ray generation comprises an electron beam source being capable of emitting an electron beam, a deflection device being arranged such that the deflection device is capable of deflecting the emitted electron beam, and an anode, wherein the anode comprises a first focal spot region and a second focal spot region, wherein the deflection device is adapted to deflect the emitted electron beam to modify a first portion of the emitted electron beam, which first portion is irradiated by the first focal spot region, and a second portion of the emitted electron beam, which second portion is irradiated by the second focal spot region, and wherein the first focal spot region, when being irradiated by the first portion of the emitted electron beam, is adapted to generate an electromagnetic ray beam, which electromagnetic ray beam is oriented to exit the exposure tube component in a pre-determined direction, and wherein the second focal spot region, when being irradiated by the second portion of the emitted electron beam, is adapted to avoid that a possible electromagnetic ray beam generated by the second portion of the emitted electron beam is oriented to exit the exposure tube component in the pre-determined direction.

To avoid that a possible electromagnetic ray beam generated by the second portion of the emitted electron beam is oriented to exit the exposure tube component in the pre-determined direction means that at least it is not incident to a significant extent on a region of an anode where from X-rays excited thereby are directed towards an object to be examined.

Thus, due to the deflection, for example, a magnetic deflection, the electron beam hitting a target of, for example, a medical rotating anode X-ray tube, can be deflected within a timeframe of, for example about 10 microseconds, over some millimetres distance on the target. An exemplary beam has, for example, a typical radiation extension of less than 10 millimetres, so that the deflection may be used to steer the beam into a beam dump region on the target, from which dump region, for example, X-rays, cannot enter the region of the exposure beam. It should be noted that the beam may be totally or only partially steered into the dump region.

It should be noted that a beam may also have a widening to form a particular propagation angle. Consequently, a direction may be also a particular section being defined by a more or less exact focal point and a radiating cone. It should be noted that a focal spot region of an anode may be understood as any region onto which an electron beam impinges. The width of the electron beam may be defined as the extension of the electron beam projection on the anode in the circumferential direction. The length of the electron beam may be defined as the extension of the electron beam projection on the anode seen from the axial direction. The length of the electron beam seen from the radial direction results from the sinus of the inclination angle multiplied with the length of the electron beam. The inclination angle may be the angle between the plane perpendicular to the rotational axis and align on the inclined surface of the first focal spot region crossing the rotational axis. Due to an inclined anode surface, a deflection of an electron beam in radial direction results in a deflection of the electromagnetic ray beam in an axial direction, i.e. in the z-direction.

According to an embodiment of the invention, the electron beam source and the first focal spot region are oriented such that the first portion of the emitted electron beam, when irradiating the first focal spot region is at a maximum at a deactivated deflection device.

Thus, it is possible to achieve the maximum output of the electron beam, for example, an X-ray beam at a deactivated deflection device, and to only activate the deflection device only in case a deflection is desired, i.e. in case a reduced intensity of the emitted electron beam is desired.

According to an embodiment of the invention, the first focal spot region is inclined to a plane being perpendicular to the electron beam.

Thus, it is possible to achieve an output of the generated electromagnetic ray, for example, an X-ray beam towards a lateral direction, into which direction, for example, an emitting window may be arranged. The deflection in a radial direction of an electron beam, which generates an electromagnetic beam when hitting the anode surface, then results in a deflection of the electromagnetic beam in z-direction.

According to an embodiment of the invention, the second focal spot region is recessed over the first focal spot region, when seen from the electron beam source.

Thus, when being deflected from the first focal spot region, the electron beam irradiates a recessed second focal spot region, so that an unattended reflection and irradiation of the generated electromagnetic ray beam in the second region may be avoided due to the depth and construction of the recessed region.

According to an embodiment of the invention, the second focal spot region comprises a slope, which slope abuts to the first focal spot region, wherein the slope is inclined with respect to the irradiating electron beam.

The inclination of the slope increases the angle between the slope and the surface of the first focal spot region in order to stabilise the geometry of the edge, which edge is exposed to an increased impact of the electron beam. Thus, a degeneration of the edge may be avoided or at least reduced. Further, such geometry will lead to an improved heat transfer in order to avoid an overheating of the edge region.

According to an embodiment of the invention, the anode is pivoted around a rotational axis, and the first focal spot region forms an annular surface of the anode, which surface being concentrically arranged around the rotational axis.

Thus, the impact per unit surface may be reduced due to the distribution of the impact to an annular surface instead of a punctual surface. It should be noted that the annular surface may be arranged on a plane being perpendicular to the rotational axis, but may also be arranged on a cone, which cone having the same rotational axis as the anode, so that the annular surface is inclined.

According to an embodiment of the invention, the second focal spot region with respect to the rotational axis is located inwardly to the first focal spot region.

Thus, the deflection of the electron beam will be carried out towards the inner of the exposure tube component, i.e. towards a direction being faced away from the intended exposure direction of the electromagnetic ray beam. This decreases the risk of an unintended stray radiation towards unintended exit regions of the tube.

According to an embodiment of the invention, the anode further comprises a third focal spot region, which third focal spot region with respect to the rotational axis is located outwardly to the first focal spot region, and wherein the third focal spot region being recessed over the first focal spot region, when seen from the electron beam source.

Thus, transition times may be minimised owing to the location of the electron beam close to the edge of the beam dump, i.e. the second and the third focal spot region. To minimise those fluctuations caused by mechanical tolerances by, for example, displacement of an anode centre of rotation and a circle describing the edge of the beam dump, i.e. the second and third focal spot region, the target surface may be shaped as a conical ring, the radial extension of which is a little smaller than the length of the beam. Thus, only some affordable part of the radiation is lost. To minimise those fluctuations, the beam may be minimally steered radially periodically according to the misalignment. The beam then may only slightly and acceptably lengthen in the radial direction. The modulation depth then may be adjusted by the amount of the beam deflection leading to a shortening of the focal spot. The third focal spot region, in particular when recessed, may form a wall region in order to avoid radiation towards an unintended direction.

According to an embodiment of the invention, the first focal spot region together with a recessed focal spot region and the recessed third focal spot region forms an annular plateau track, wherein the width of the annular plateau track is smaller or equal than the length of the electron beam.

According to an embodiment of the invention, the deflection device comprises a coil arrangement.

Thus, the deflection may be carried out by a magnetic field.

According to an embodiment of the invention, an anode comprises a first focal spot region and a second focal spot region, wherein the first focal spot region, when being irradiated by a first portion of an emitted electron beam, is adapted to generate an electromagnetic ray beam, which electromagnetic ray beam is oriented to exit the anode in a predetermined direction, and wherein the second focal spot region, when being irradiated by a second portion of an emitted electron beam, is adapted to avoid that a possible electromagnetic ray beam generated by a second portion of an emitted electron beam, is oriented to exit the anode to the predetermined direction.

According to an embodiment of the invention, an examining exposure apparatus comprises an inventive exposure tube component or an inventive anode.

It should be noted that above features may also be combined, in particular the features described with respect to the exposure tube component may also be applied to the anode as such. The combination of the above features may also lead to synergetic effects, even if not explicitly described in detail.

It may be seen as a gist of the present invention to provide a particular target region onto an anode allowing a fast modulation due to a minimum deflection distance while maintaining the exact intended dose for the examining procedure.

These and other aspects of the present invention will become apparent from and elucidated with reference to the embodiments described hereinafter.

BRIEF DESCRIPTION OF THE DRAWINGS

Exemplary embodiments of the present invention will be described in the following with reference to the following drawings.

DETAILED DESCRIPTION OF EXEMPLARY EMBODIMENTS

Figure 1:
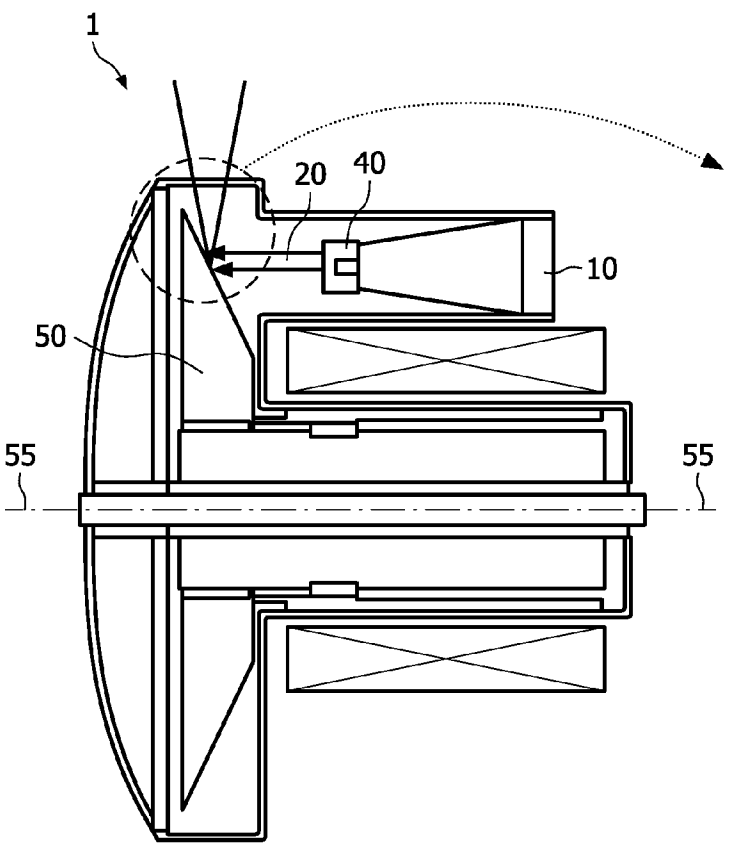
FIG. 1 illustrates a cross sectional view of an exposure tube comprising an exposure tube component of the invention.

FIG. 1 illustrates a cross sectional view of an exposure tube, in particular an X-ray exposure tube comprising an exposure tube component for an electromagnetic ray generation, in particular an X-ray generation. According to an exemplary embodiment of the invention, the exposure tube comprises a housing, into which a pivoted anode 50 is provided, which anode rotates around a rotational axis 55. The exposure tube component 1 comprises an electron beam source 10, which source is capable of emitting an electron beam 20. The electron beam may be deflected by a deflection device 40. The electron beam hits the surface of the anode 50 and owing to its high impact energy generates an electromagnetic ray, in particular an X-ray, which may be emitted via a not particular denoted window on e.g. the lateral side of the exposure tube.

Figure 2:
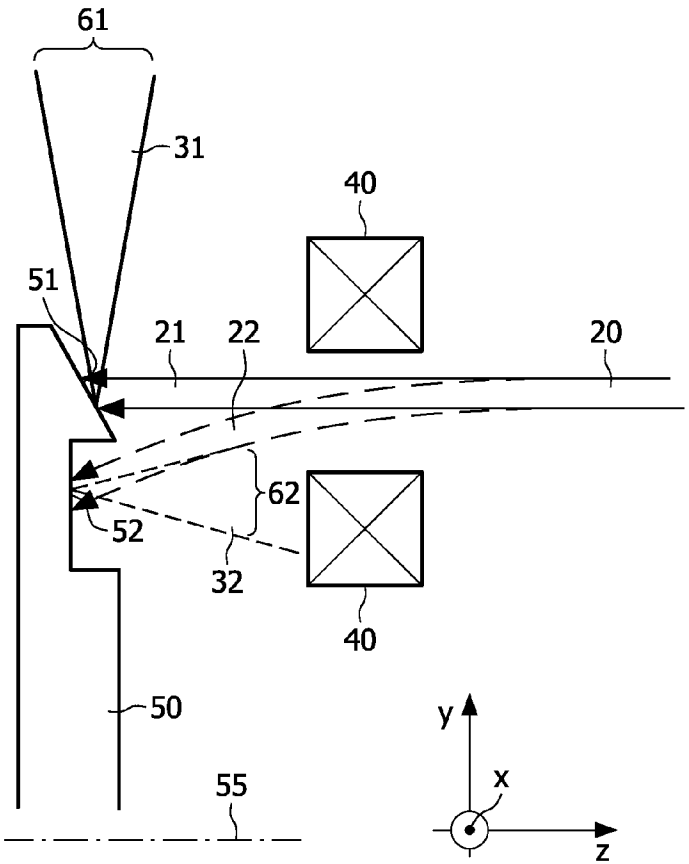
FIG. 2 illustrates an enlarged cross sectional view of the deflection device and anode according to an embodiment of the invention.

FIG. 2 illustrates an enlarged view of the cross sectional view of FIG. 1, in particular the electron beam 20, the deflection device 40 and the anode configuration of the anode 50. If the deflection device 40, for example, in form of a pair of coils remains deactivated, the electron beam propagates without any deflection from the electron beam source 10 (not shown) to a surface 51 of the anode 50. If the electron beam 20 hits the surface of the anode 50, the electron beam 20 generates an electromagnetic ray, in particular an X-ray beam 31 into a pre-determined direction 61. In this case, the electron beam 20 meets the surface of the anode on a first focal spot region 51, which is adapted to generate an electromagnetic ray beam 31 into the first pre-determined direction 61. However, if the electron beam 20 will be deflected, for example, by an activated deflection device 40, the electron beam hits the anode 50 in a second focal spot region 52. The deflected electron beam 20 will generate an electromagnetic ray beam 32 in a second direction 62, which is different from and particularly not part of the first pre-determined direction 61. The first direction 61 is oriented to let the electromagnetic X-ray radiation leave the exposure tube via a particular window (not shown), wherein the second direction 62 is directed into a direction which does not cover the area of the window. Given that the recess of the region 52 is sufficiently deep in axial direction and the remaining radial wall structure is sufficiently thick with respect to the penetration capability of the electromagnetic radiation, the anode material is attenuating the radiation and prevents it from entering the direction 61. Thus, by deflecting the electron beam 20 to the second focal spot region 52, it may be avoided to emit the possible electromagnetic ray beam 32 into the first pre-determined direction 61, so that the amount of electromagnetic ray may be controlled by the amount of the deflection. It should be understood, that the electron beam 20 may also be deflected in a reduced amount, so that only a part of the electron beam 20 in form of a first portion 21 hits the first focal spot region 51, wherein the remaining part of the electron beam 20 in form of a second portion 22 will hit the second focal spot region 52. Thus, the total amount and intensity, respectively, of the electromagnetic ray beam may be influenced by deflecting the electron beam 20. In case of a recessed second region also the focal spot size of the electron beam may get widened due to a different distance between the source and the first region and the source and the second region.

When using a coil or a pair of coils as a deflection device 40, magnetic deflection may be used for deflecting the electron beam hitting the target of a medical rotating anode X-ray tube. The deflection may be carried out within a very short timeframe, for example, of about 10 microseconds, and over a very short distance, for example, over some millimetres on the target, i.e. the focal spot region. The electron beam may have, for example, a typical radial extension of less than 10 millimetres. A deflection may be used to steer a beam from a first focal spot region 51 to a second focal spot region 52, or vice versa. The second focal spot region 52 in this embodiment may be considered as a beam dump region on the anode surface, from where electromagnetic rays 32, in particular X-rays, cannot enter the useful electromagnetic ray beam 31 in a pre-determined direction 61. This may result from the recessed dead end construction avoiding an unintended stray of the beam, as well as a defocusing due to changed distances. By deflecting the beam only partially, the amount of emitted useful electromagnetic ray beam may be controlled within very low tolerances.

Figure 3:
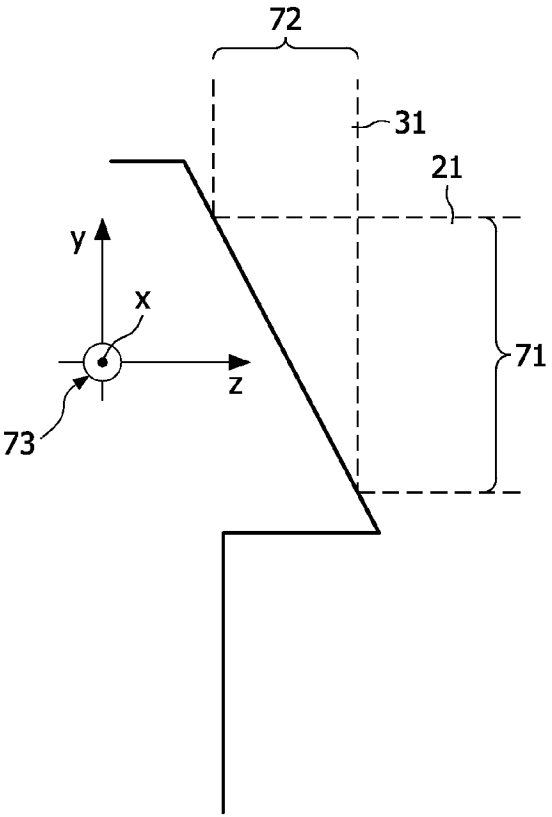
FIG. 3 illustrates the definition of the width and length of an electron beam.

FIG. 3 illustrates schematically the incoming electron beam 20, in particular the first portion 21 of the electron beam 20 and the emitted electromagnetic ray beam 31. The z direction is assumed to be the direction of the rotational axis 55 of the anode 50, the y direction is considered to be the radial direction of the anode 50, being perpendicular to the rotational axis 55, and the x direction is considered to be the circumferential direction of the anode 50 throughout the description. The width of the electron beam is defined as the extension of the electron beam projection on the anode in the circumferential direction 73, i.e. the x direction. The length of the electron beam is defined as the extension of the electron beam projection on the anode in the axial direction 71, i.e. the y direction. Due to the inclined surface of the anode of the first focal spot region 51, the dimension of the emitted electromagnetic ray will change, as it can be seen from FIG. 4. This change takes place in the axial direction, i.e. the z direction.

Figure 4:
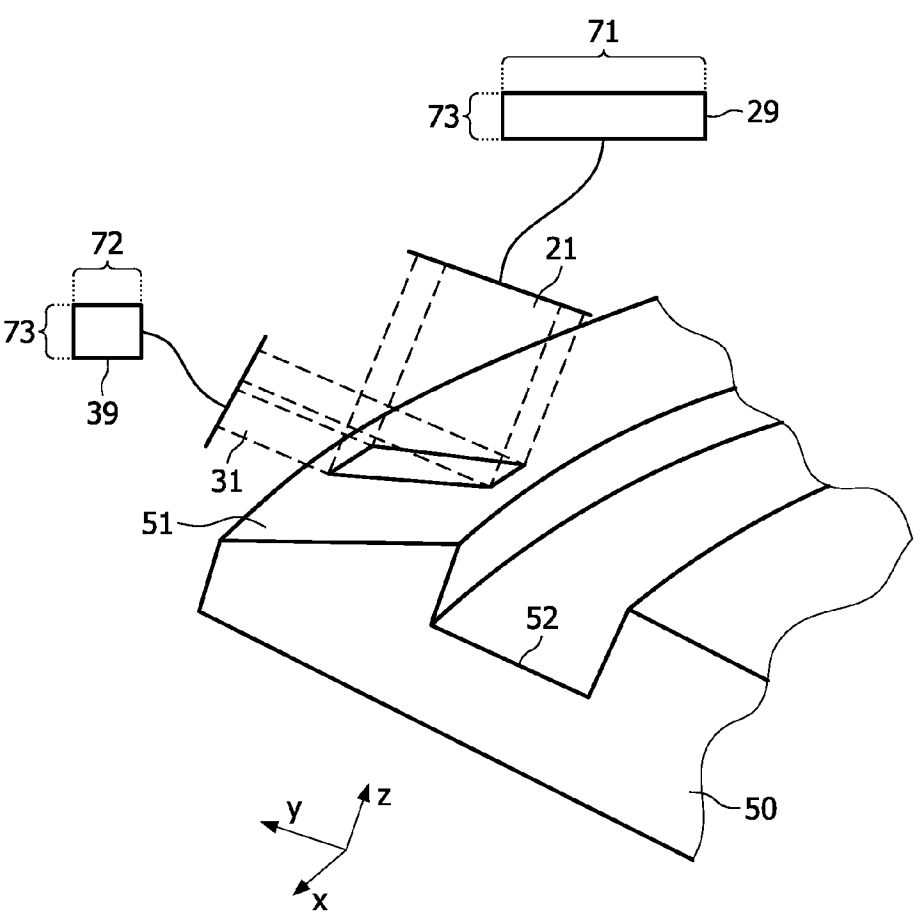
FIG. 4 illustrates the definition of the width and length of an electron beam under consideration of an inclination angle of the anode surface.

FIG. 4 illustrates a perspective view of the area of interest of the anode 50. The irradiating electron beam has the cross sectional form 29 given by the length 71 and the width 73 of the electron beam 20, or in particular the first portion 21 of the electron beam 20. The emitted electromagnetic ray has a cross sectional form 39 given by the length of the electromagnetic ray beam 72 and the width 73 corresponding to the width of the electron beam. The relation between the length of the electron beam 71 and the length of the electromagnetic ray 72 is given by the sinus function of the inclination of the first focal spot region 51 by an inclination angle $\alpha$ (alpha). FIG. 4 illustrates a case, in which the complete electron beam 20 hits the first focal spot region 51. However, it is also possible that the electron beam 20 will hit the first focal spot region 51 only with its first portion 21, so that only a part of the electron beam will hit the first focal spot region 51, wherein the remaining part 22 of the electron beam will hit the second focal spot region 52, which, however, is not shown in FIG. 4. In this case, the length of the electron beam hitting the first focal spot region will be reduced, so that also the length of the electromagnetic ray being emitted from the first focal spot region 51 will be reduced.

Figure 5:
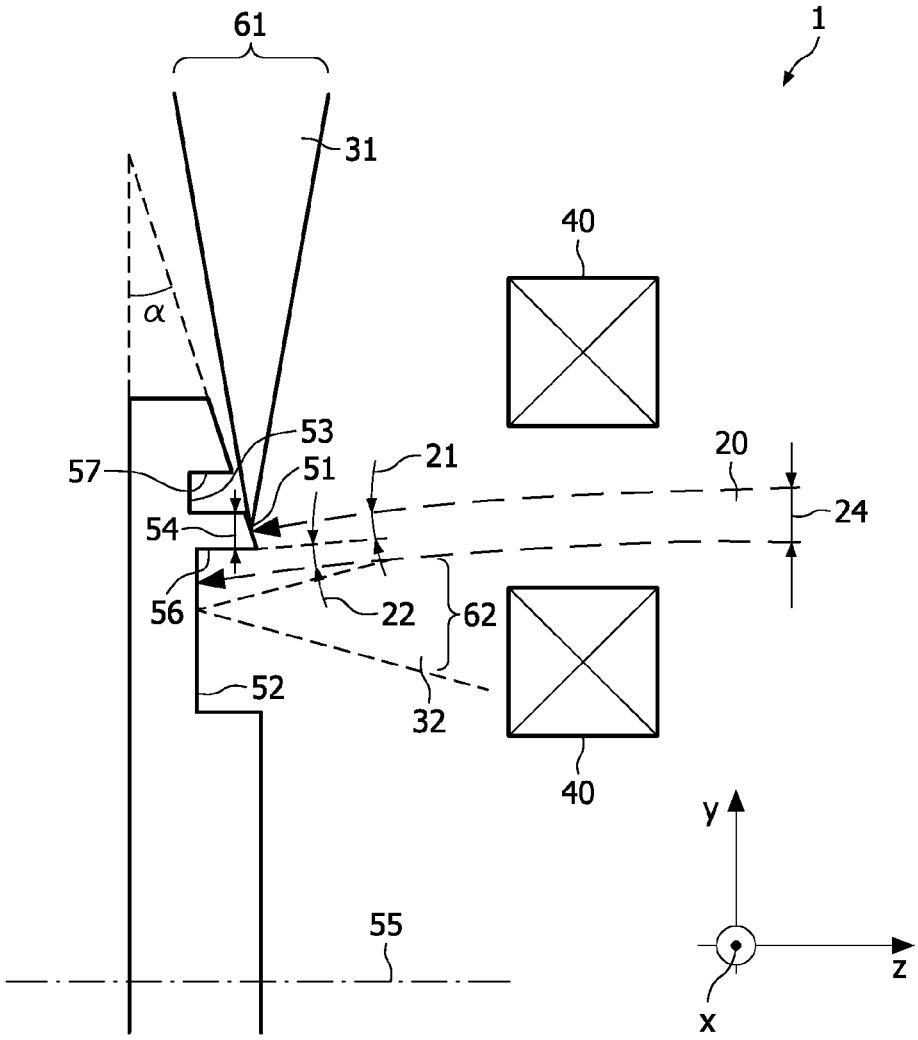
FIG. 5 illustrates an enlarged cross sectional view of the deflection device, the electron beam and the anode configuration according to an embodiment of the invention.

FIG. 5 illustrates an embodiment of the invention, in which a third focal spot region 53 is provided. In the embodiment shown in FIG. 5, the second focal spot region 52, as well as the third focal spot region 53 are formed as a recessed surface portion over the first focal spot region. Thus, the first focal spot region 51 forms a plateau track having a pre-determined width 54. The surface of the first focal spot region 55 may be inclined over the plane being perpendicular to the rotational axis 55 by an inclination angle $\alpha$ (alpha). In a particular case, the electron beam 20 having a predetermined total diameter or dimension 24 will hit the first focal spot region 55 by its first portion 21, wherein the electron beam 20 will hit the second focal spot region 52 by its second portion 22. The first portion 21 will generate an electromagnetic ray beam 31 in a predetermined range 61, which is used for the exposure and examination, wherein the second part of the electromagnetic ray 32 being generated by the second portion 22 of the electron beam 20 will be emitted into a different direction 62, which is not used for the exposure and examination. Thus, the amount of useful electromagnetic ray 31 into the pre-determined direction 61 may be controlled via the deflection device 40. The third focal spot region, in particular when recessed, may form a wall region (57) in order to avoid radiation towards an unintended direction.

By providing a plateau of the first focal spot region 51 having a pre-determined width 54, the maximum length of the electron beam 20 hitting the first focal spot region 51 may be set very exactly, even if the rotational axis deviates in a wider range of tolerances. For minimised transition times of the electron beam 20 from the first focal spot region 51 to the second focal spot region 52, the beam may be located close to the edge of the beam dump, i.e. the edge between the first focal spot region 51 and the second focal spot region 52. The surface of the first focal spot region 51 as the target of the electron beam 20, in particular its first portion 21, may be formed in the shape of a conical ring, the radial extension thereof is a little bit smaller than the length of the beam. In other words, the width 54 of the plateau in this case may be smaller than the length 71 corresponding to the diameter 24 of the electron beam at the intersection with the anode surface.

The second focal spot region 52 may comprise a slope 56, which slope abuts to the first focal spot region 51, wherein the slope 56 is inclined with respect to the rotating axis 55 so that the angle between the slope 56 and the surface of the first focal spot region 51 will be increased. The inclination increases the angle between the slope surface and the surface of the first focal spot region in order to reduce the impact due to the exposure of the edge, in which the first focal spot region abuts to the slope 56. In particular, the heat transfer from the particular exposed abutting edge will be improved due to the larger cross section of the material, so that the heat generated by the impact of the electron beam on to the first focal spot region will be conducted towards the base of the anode 50. It should be noted that generally the width 54 of the plateau of the first focal spot region 51 may be manufactured much more precisely than the length of the electron beam may be designed.

Figure 6:
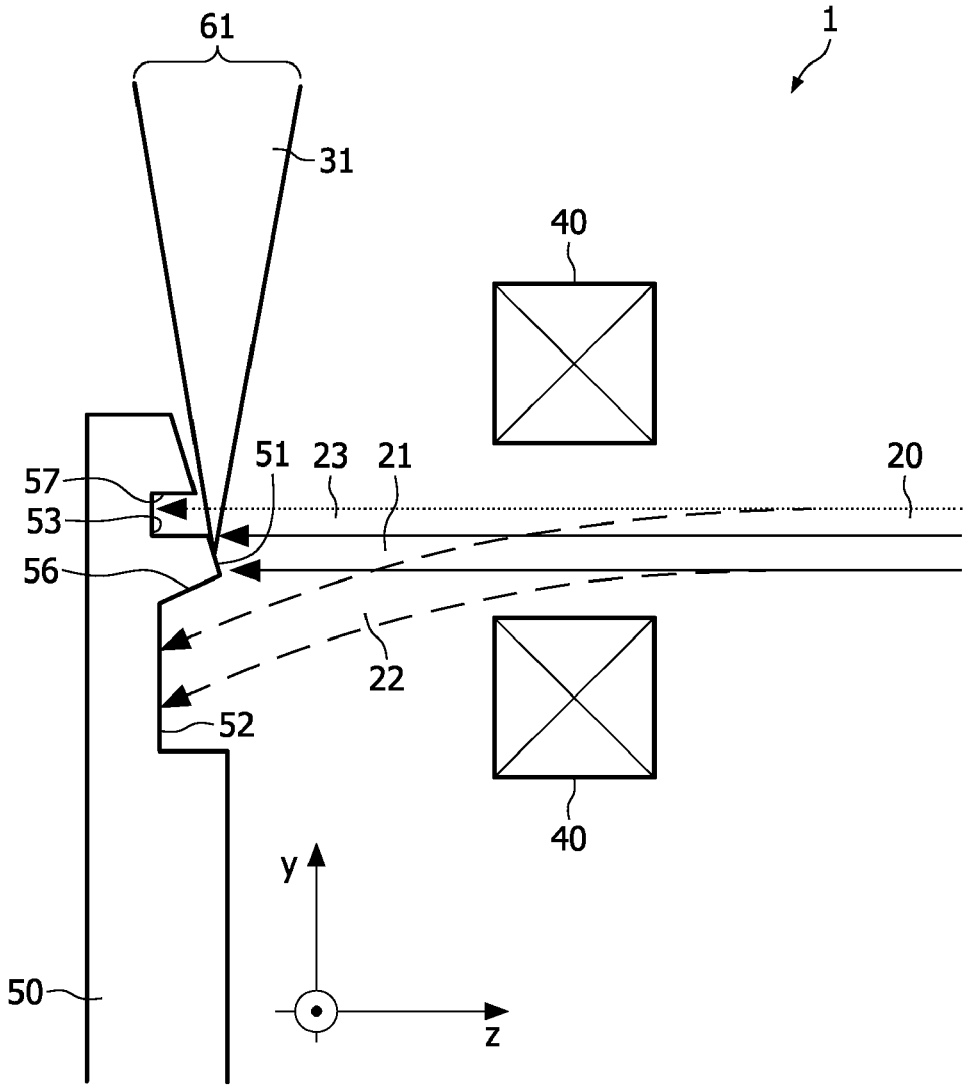
FIG. 6 illustrates the configuration of the deflection device, the electron beam and the anode configuration according to an embodiment of the invention.

FIG. 6 illustrates an embodiment of the invention, where the total electron beam 20 comprises a first portion 21 hitting the first focal spot region 51, a second portion 22 hitting the second focal spot region 52 and a third portion 23 hitting the third focal spot region 53. Only the first portion 21 of the electron beam 20 is used for the generation of a useful electromagnetic ray 31 in a pre-determined direction 61, wherein the remaining portions 22 and 23 of the electron beam do not contribute to a useful electromagnetic ray generation due to the depth and construction of the recessed second and third focal spot regions 52 and 53.

With the present invention, the dose modulation may be carried out with transition times of about 10 microseconds or less, even if using presently known magnetic deflection techniques. This allows for a pulse width modulation of the dose applied within each view of a computer tomography scan. Further, a fast partial dose modulation between, for example, 20 and 100% becomes possible without reducing the quality of the focused electron beam. It should be noted that using a grid switch by an electric means next to the emitter allows only for a total shut off from 100% to zero. With the present invention, the focal spot is only minimally distorted during the transition period. The focal spot may be shortened but a high spatial resolution of the computer tomography system may be maintained.

Mechanical tolerances tend to translate into periodic dose fluctuations. Steering the beam on the side of the third focal spot region 53 will minimise this effect. The dose fluctuation may be measured and the deflection control system may react accordingly, for example, by keeping the beam exactly at the mechanical edge of a beam dump, i.e. the abutting edge of the slope 56 and the first focal spot region 51.

It should be noted that the invention may also be applied to any exposure tube being designed for electromagnetic wave generation, and thus, is not limited to an X-ray generation.

It should be noted that the term 'comprising' does not exclude other elements or steps and the term 'a' or 'an' does not exclude a plurality. Also elements described in association with the different embodiments may be combined.

It should be noted that the reference signs in the claims shall not be construed as limiting the scope of the claims.

The invention claimed is:

1. An exposure tube component for electromagnetic X-ray generation, comprising:

an electron beam source being capable of emitting an electron beam;

a deflection device being arranged such that the deflection device is capable of deflecting the emitted electron beam;

an anode having a rotational axis, wherein the anode is pivoted around the rotational axis; and a lateral emitting window arranged in a direction perpendicular to the rotational axis;

wherein the anode comprises a first focal spot region and a second focal spot region, wherein the first focal spot region forms an annular surface of the anode that is concentrically arranged around the rotational axis, wherein the deflection device is adapted to deflect the emitted electron beam to modify a first portion of the emitted electron beam, which first portion is irradiating the first focal spot region, and a second portion of the emitted electron beam, which second portion is irradiating the second focal spot region, wherein the second focal spot region is recessed over the first focal spot region when seen from the electron beam source, and wherein the first focal spot region, when being irradiated by the first portion of the emitted electron beam, is adapted to generate an electromagnetic X-ray beam, which electromagnetic X-ray beam is oriented to exit the exposure tube component in a predetermined direction through the lateral emitting window, and wherein the second focal spot region, when being irradiated by the second portion of the emitted electron beam, is adapted to avoid that a possible electromagnetic X-ray beam generated by the second portion of the emitted electron beam is orientated to exit the exposure tube component through the lateral emitting window.

2. The exposure tube component of claim 1, wherein the electron beam source and the first focal spot region are oriented such that the first portion of the emitted electron beam when irradiating the first focal spot region is at a maximum at a first state of activation of the deflection device and less than maximal at other states of activation of the deflection device.

3. The exposure tube component of claim 2, wherein the first state of activation is a deactivated state.

4. The exposure tube component of claim 1, wherein the first focal spot region is inclined to a plane being perpendicular to the electron beam.

5. The exposure tube component of claim 1, wherein the second focal spot region comprises a slope, which slope abuts to the first focal spot region, wherein the slope is inclined with respect to the irradiating electron beam.

6. The exposure tube component of claim 1, wherein the second focal spot region with respect to the rotational axis is located inwardly to the first focal spot region.

7. The exposure tube component of claim 1, wherein the anode further comprises a third focal spot region, which third focal spot region with respect to the rotational axis is located outwardly to the first focal spot region, and wherein the third focal spot region being recessed over the first focal spot region, when seen from the electron beam source.

8. The exposure tube component of claim 7, wherein the third focal spot region forms a wall structure.

9. The exposure tube component of claim 7, wherein the first focal spot region together with the recessed second focal spot region and the recessed third focal spot region forms an annular plateau track, wherein the width of the annular plateau track is smaller or equal to the length of the electron beam.

10. The exposure tube component of claim 7, wherein the first focal spot region together with the recessed second focal spot region and the recessed third focal spot region forms an annular plateau track, wherein the width of the annular plateau track is larger than the length of the electron beam.

11. The exposure tube component of claim 1, wherein the deflection device comprises a coil arrangement.

12. An apparatus for examining a patient comprising an exposure tube component of claim 1.

13. An anode comprising:

a rotational axis, wherein the anode is pivoted around the rotational axis;

a first focal spot region forming an annular surface of the anode that is concentrically arranged around the rotational axis; and a second focal spot region;

wherein the first focal spot region, when being irradiated by a first portion of an emitted electron beam, is adapted to generate an electromagnetic X-ray beam, which electromagnetic X-ray beam is oriented to exit the anode in a predetermined direction perpendicular to the rotational axis through an emitting window, wherein the second focal spot region is recessed over the first focal spot region when seen from the direction of the electron beam, and wherein the second focal spot region, when being irradiated by a second portion of an emitted electron beam, is adapted to avoid that a possible electromagnetic X-ray beam generated by a second portion of an emitted electron beam, is orientated to exit the anode through the emitting window.

14. The anode of claim 13, further comprising:

a third focal spot region;

wherein the second and the third focal spot regions, when being irradiated by a second portion of an emitted electron beam, are adapted to avoid that a possible electromagnetic X-ray beam generated by a second portion of an emitted electron beam is orientated to exit the anode through the emitting window.

* * * * *